US006902601B2

(12) United States Patent
Nie et al.

(10) Patent No.: US 6,902,601 B2
(45) Date of Patent: Jun. 7, 2005

(54) METHOD OF MAKING ELEMENTAL MATERIALS AND ALLOYS

(75) Inventors: Jason X. Nie, Severna Park, MD (US); Robert Daniels, Phoenix, MD (US); Dale H. Perkins-Banks, Laurel, MD (US); Thomas Messer, Columbia, MD (US)

(73) Assignee: Millennium Inorganic Chemicals, Inc., Hunt Valley, MD (US)

( * ) Notice: Subject to any disclaimer, the term of this patent is extended or adjusted under 35 U.S.C. 154(b) by 27 days.

(21) Appl. No.: 10/242,916

(22) Filed: Sep. 12, 2002

(65) Prior Publication Data

US 2004/0050208 A1 Mar. 18, 2004

(51) Int. Cl.[7] ..... B22F 9/22; B22F 9/26; B22F 9/28

(52) U.S. Cl. ..... 75/351; 75/365; 75/369; 75/617; 75/619; 75/620

(58) Field of Search ..... 75/351, 364, 365, 75/369, 613, 617, 619, 620

(56) References Cited

U.S. PATENT DOCUMENTS

| | | | | |
|---|---|---|---|---|
| 2,205,854 | A | 6/1940 | Kroll | |
| 2,707,168 | A | 4/1955 | Wainer et al. | |
| 2,707,169 | A | 4/1955 | Steinberg et al. | |
| 2,874,040 | A | 2/1959 | Ferraro, Jr. | |
| 2,891,857 | A | 6/1959 | Eaton | |
| 3,123,464 | A | 3/1964 | Casey et al. | |
| 4,830,665 | A | 5/1989 | Winand | |
| 4,877,445 | A | * 10/1989 | Okudaira et al. | 75/366 |
| 5,032,176 | A | 7/1991 | Kametani et al. | |
| 5,503,655 | A | 4/1996 | Joseph | |
| 5,707,419 | A | 1/1998 | Tsantrizos et al. | |
| 5,749,937 | A | 5/1998 | Detering et al. | |
| 5,779,761 | A | 7/1998 | Armstrong et al. | |
| 5,935,293 | A | 8/1999 | Detering et al. | |
| 5,958,106 | A | 9/1999 | Armstrong et al. | |
| 6,066,359 | A | 5/2000 | Yao et al. | |
| 6,117,208 | A | 9/2000 | Sharma | |
| 6,136,060 | A | 10/2000 | Joseph | |
| 6,136,706 | A | 10/2000 | Jabotinski et al. | |
| 6,152,982 | A | 11/2000 | Froes et al. | |
| 6,168,644 | B1 | 1/2001 | Fukasawa et al. | |
| 6,231,636 | B1 | 5/2001 | Froes et al. | |
| 6,387,347 | B1 | 5/2002 | Deberry et al. | |
| 6,409,792 | B1 | 6/2002 | Schutz et al. | |
| 6,409,797 | B2 | 6/2002 | Armstrong et al. | |
| 6,409,852 | B1 | 6/2002 | Lin et al. | |
| 2002/0184971 | A1 | 12/2002 | Myrick | |

FOREIGN PATENT DOCUMENTS

| | | |
|---|---|---|
| EP | 1 211 003 A2 | 6/2002 |
| GB | 713446 | 8/1954 |

(Continued)

OTHER PUBLICATIONS

Michael Bauccio, Editor, "ASM Metals Reference Handbook: 3rd Edition," ASM International, pp. 382–386 (1997).

(Continued)

*Primary Examiner*—George Wyszomierski
(74) *Attorney, Agent, or Firm*—Kalow & Springut LLP; Scott D. Locke, Esq.

(57) ABSTRACT

A method of producing an elemental material or an alloy thereof from a halide or mixtures of halides is provided. The halide or mixtures thereof are contacted with a reducing gas in the presence of reductant material, preferably in sufficient quantity to convert the halide to the elemental material or alloy and to maintain the temperature of the reactants at a temperature lower than the boiling point of the reductant material at atmospheric pressure or the sintering temperature of the produced elemental material or alloy.

20 Claims, 3 Drawing Sheets

FOREIGN PATENT DOCUMENTS

| | | |
|---|---|---|
| JP | 2002-47501 | 2/2002 |
| JP | 2002047501 | 2/2002 |
| JP | 2002-88456 | 3/2002 |
| JP | 2002088456 | 3/2002 |
| WO | WO 99/64638 | 12/1999 |
| WO | WO 00/10756 | 3/2000 |
| WO | WO-01/45906 A2 * | 6/2001 |

OTHER PUBLICATIONS

Du Pont, "Sodium—Price List Dated Jan. 1, 1997," http://www.dupont.com/sodium/price.html.
Kersti Ahlberg, "AGA Gas Handbook," AGA AB, Lindingo, Sweden, pp. 309–319, (1985).
David. R. Lide, Ph.D., "CRC Handbook of Chemistry and Physics: 73rd Edition," CRC Press, Boca Raton (1993).
Alvin Glassner, "The Thermochemical Properties of the Oxides, Flourids, and Chlorides to 2500K," Argonne National Laboratory, (1958).
D.W. Green, ed., "Perry's Chemical Engineer's Handbook: Sixth Edition," McGraw–Hill, Inc., N.Y., pp. 23–58–23–66 (1984).
Burton et al. "Optimisation of the Preparation of Ceria/Zirconia Mixed Oxides by a Statistical Approach",MELCat, Doc 6100 (1999).
Cordes, R.A. et al., "Titanium Metal Powder Protection by the Plasma Quench Process," Final Report Jan. 31, 1997 – Dec. 31, 1999 (Sep. 2000).
Outokumpu Co, "HSC Chemistry—Chemical Reaction and Equilibrium Software with Extensive Thermochemical Database," Version 4.0, www.outokumpu.com, 1999, Table of Contents and charts.
Department of Industry, Science and Resources of Emerging Industries, "Titanium Metal—a market analysis," Industry Science Resource, Feb. 2001.
Chemical Market Reporter, "Prices & People," Section 4, Jan. 7, 2002.
American Metal Market®, Jan. 10, 2002.
European Chemical News, "AAC Anhydrous aluminum chloride," Mar. 27 –Apr. 2, 2000 p. 22.
SRI International, "Chemical Economics Handbook," Sep. 2000, p. 747.2000G–U; Nov. 2001, p. 702.2002D, E, G, H, U.
Kirk–Othmer, Encyclopedia of Chemical Technology, "Sodium and Sodium Alloys," 3d ed., New York, John Wiley and Sons, 1992, vol. 22, p. 341; vol. A24, p. 296.
Kirk–Othmer, Encyclopedia of Chemical Technology, "Lithium Compounds," 4th ed., New York, John Wiley and Sons, 1995, vol. 15, pp. 445–446 and 412–413.
J. A. Ober, "Lithium," U.S. Geological Survey Minerals Yearbook—2000, pp. 47.1–47.6, Tables 1–5.
J.A. Ober, "Lithium," U.S. Geological Survey Mineral Commodity Summaries, Jan. 2001, pp. 96–97.
J.A. Ober, "Lithium," Metal Prices in the United States through 1998, U.S. Geological Survey, pp. 77–78.
J.B. Hedrick, "Zirconium," U.S. Geological Survey Metal Prices in the United States through 1998, U.S. Geological Survey, pp. 175–178.
Hendrick, James B., "Zirconium and Hafnium," U.S. Geological Survey, Mineral Commodity Summaries, Jan. 2001, pp. 188–189.
Hendrick, James B., "Zirconium and Hafnium," U.S. Geological Survey Minerals Yearbook—2000, pp. 87.1–87.6 and Tables 1–5.
Zirconium and Zirconium Compounds, Ullmans's Encyclopedia of Industrial Chemistry, New York, N.Y., YCH Publishers, pp. 555–556 (1996).
Kirk–Othmer, "Potassium," 1996, vol. 19, pp. 1050–1051.
"Potassium and Potassium Alloys," Ullman's Encyclopedia of Industrial Chemistry, vol. A22, pp. 31, 33–34.
Searls, James P., "Potesh," U.S. Geological Survey, Mineral Commodity Summaries, Jan. 2001.
"Potash—Crop Year 2001," Mineral Industry Surveys, U.S. Department of Interior, Oct. 2001.
Searls, James P., "Potash," U.S. Geological Survey Minerals Yearbook, 2000, pp. 60.11–60.5 and Tables 1–10.
L.R. Matricardi and J. Downing, "Manganese and Manganese Alloys," in Kirk–Othmer Encyclopedia of Chemical Technology, 4th ed., New York, John Wiley and Sons, 1995, vol. 15, pp. 963, 985–987.
"Maganese and Maganese Alloys," Ullman, 1990, pp. 118–119.
"Maganese, A Myrid of Minor Markets," Industrial Minerals, Nov. 1993, p. 25.
"Magnaese," U.S. Geological Survey, Mineral Commodity Summary, Jan. 2001, pp. 102–103.
"Maganese in Oct. 2001," Mineral Industry Surveys, U.S. Department of the Interior, Jan. 2002.
Jones, Thomas S., "Maganese," Metal Prices in the United States through 1998, USGS, p. 83–86.
M. D. Fenton, "Ferroalloys," 1999 p. 27.1 and Tables 1–6.
Chemical Economics Handbook–SRI International, "Sodium Chloride," 2002, p. 770.8000Y.
Chemical Market Report, "Potassium Chloride—Chemical grade," Jun. 17, 2002.
Kroll, Wm J., "Titanium in a Cold–Malleable Form," Brit. 658,213, Chem. Abstract, vol. 46;404.
"PCT International Search Report," International Searching Authority United States (ISA/US), Mar. 12, 2004.

* cited by examiner

METHOD OF MAKING ELEMENTAL MATERIALS AND ALLOYS

FIELD OF THE INVENTION

The present invention relates to the field of the production of elemental materials and alloys.

BACKGROUND OF THE INVENTION

Often it is desirable to obtain substances in their elemental forms or high quality alloys of these substances in order to use them in certain high-end applications, for example, sports and leisure activities. However, in nature most substances are not readily accessible in their elemental forms.

For example, frequently titanium occurs in ores as a dioxide or mixed oxide with iron. Because of titanium's affinity for gases and most metals in the periodic table, it is quite difficult to extract elemental titanium from its ores. Consequently, in order to obtain elemental Ti, complex and now well-known processes have been developed. Unfortunately, these processes, as well as similar processes for obtaining other elemental materials can be cumbersome and costly.

Many naturally occurring substances either exist as halides or are easily converted into halides. These halides may be reduced to their elemental forms by any one of a number of well-known processes. For example, titanium tetrachloride ($TiCl_4$) may be reduced to Ti through the use of reducing agents such as hydrogen, carbon, sodium, calcium, aluminum or magnesium.

Methods for reducing halides in order to obtain elemental materials have been developed for both batch and continuous processes. One example of a method for the reduction of a precursor material in a batch process is the magnesium reduction of titanium tetrachloride to produce elemental titanium. Unfortunately, the product of this type of batch process requires significant material handling, which provides opportunities for contamination and variation in quality from batch to batch. Consequently, a significant amount of effort has been directed toward developing continuous reduction processes.

Several different continuous processes for producing elemental materials have been developed. For example, it is known to use Na to reduce $TiCl_4$ to Ti powder at a temperature of between 350 and 800° C. This process can efficiently produce Ti powder from $TiCl_4$ at a reasonable cost. Thus, it has high commercialization potential. However, the product Ti powder has a relatively high oxygen concentration, which causes powder sintering. Further, in this process there is an undesirable cumbersome step of separating the Ti powder from Na. Still further, Na can be costly, is of limited supply and must be handled carefully.

Another method for reduction of a precursor material, for example, for the production of titanium, uses plasma technology to change the thermodynamics of the elemental Ti formation by vaporizing and ionizing it. However, due to the high melting temperature of titanium metal, most plasmas operate at temperatures of above 4000° C. Therefore, the high energy consumption and the limited refractory material availability render this process expensive.

Another known method involves the use of an electron beam to produce Ti powder. This process is conceptually similar to a plasma process, that is, by utilizing the high temperature from an electron beam, one may produce Ti powder. Unfortunately, this process also consumes a great deal of energy and can be costly.

Still another known method uses mechanochemical technology to produce Ti powder. In this process, $TiO_2/TiCl_4$ and CaH/MgH are first milled to produce $TiH+CaO/CaCl_2$ at temperatures from room temperature to 700° C. Then, TiH is annealed in a vacuum to produce Ti powder. This process is still in the early stage relative to industrial utilization, and thus far, it appears that the products of this method may suffer from being impure and having slow reaction rates.

In addition to these processes, it has long been known to produce spongy Ti by electrolysis of $TiO_2$ in a fused salt bath. In one known process, $TiO_2$ is directly electrolyzed in fused $CaCl_2$ at approximately 950° C. to produce a Ti sponge, and the sponge is converted to a powder. Unfortunately, due to the limitations of current technology, it is difficult, if not impossible, to avoid oxygen contamination on the product since the Ti sponge is produced on the surface of $TiO_2$.

The aforementioned methods all suffer from being unable to produce sufficiently pure elemental materials in a sufficiently economical manner. Because of the limitations of these methods, the ability to produce high quality alloys containing these elemental materials is also limited. The present invention provides a solution to these problems by providing methods for economically producing sufficiently high quality elemental materials and alloys.

SUMMARY OF THE INVENTION

The present invention is directed to the production of elemental materials and alloys of those materials from the halide precursors thereof, and provides methods for producing elemental materials and alloys of metals and non-metals. The elemental materials and alloys may, for example, comprise Al, As, Sb, Be, B, Ta, Ge, V, Nb, Mo, Ga, Ir, Rh, Os, Ru, Pt, Pd, Ti, U or Re. Preferably, according to the methods for producing these materials, accompanying the reduction of the halide precursor is the production of a significant amount of heat.

In one embodiment, the present invention provides a method of producing an elemental material, said method comprising:

(a) combining a precursor material with a reducing gas to form an elemental material and a first reaction product, wherein said precursor material comprises a halide of an elemental material; and (b) exposing said first reaction product to a reductant material to form a reductant-halide.

Under this embodiment, typically the first reaction product will be a gas or vapor, while the second reaction product is a solid, liquid, gas or mixture thereof, and the concentration of the first reaction product is controlled by the formation of the reductant-halide.

In a preferred embodiment, the present invention provides a method of producing Ti, said method comprising introducing $TiCl_4$ in the form of a vapor or droplet to $H_2$ to produce Ti and HCl, and exposing the HCl to a reductant solid or liquid selected from the group consisting of Al, Mn, Mg, Na, Ca, K, Li, Ba Be, Ce, Cs, Hf, Pa, Rb, Sr, Th, U, and Zr.

In a second embodiment, one may form an alloy by using a seed material in connection with the first embodiment.

In a third embodiment, the present invention provides a method for producing an alloy by combining more than one precursor material with a reducing gas to form an alloy material and one or more first reaction products. The one or more first reaction products are in turn exposed to a reductant material.

The present invention can be used in batch or continuous processes. However, the present invention is particularly beneficial when used in continuous processes. Accordingly, the present invention provides methods for producing elemental materials and alloys through continuous processes that have capital and operating cost advantages over existing technologies.

Additionally, the present invention is particularly beneficial in connection with reduction reactions that produce elemental materials and alloys from the exothermic reduction of precursor materials, and preventing the substances that are produced from sintering onto the apparatuses used to produce them. In addition to providing methods for producing elemental materials and alloys thereof, the present invention provides a means for recovering and reusing the reducing gas, thereby substantially reducing the environmental impact of the process.

DETAILED DESCRIPTION OF THE INVENTION

Figure 1:
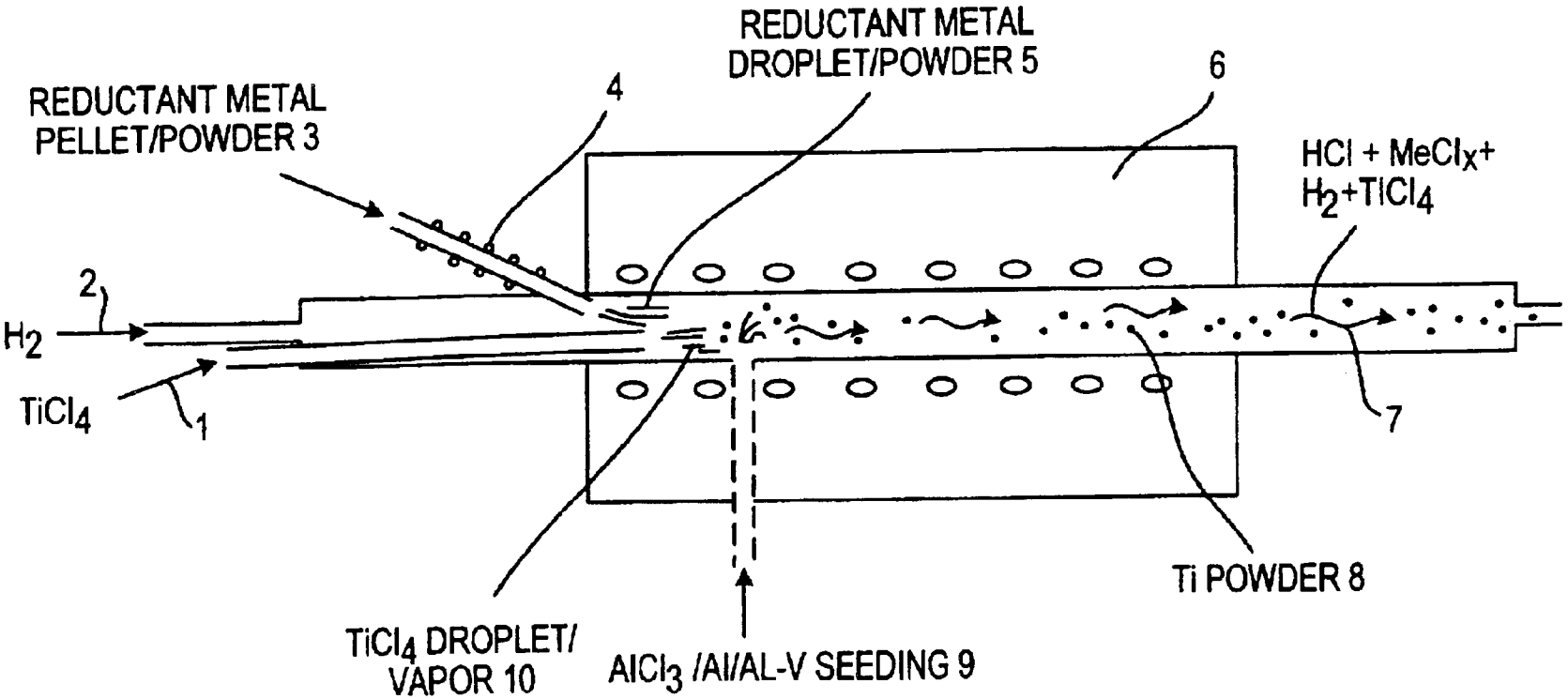
FIG. 1 is a representation of the titanium tetrachloride and reductant-metal injection reactor of continuous titanium powder production by hydrogen and reductant materials.

According to the present invention, a precursor material or a set of more than one precursor materials is exposed to a reducing gas to yield a metal, non-metal or alloy and one or more first reaction products. The one or more first reaction products are exposed to a reductant material to form a reductant-halide or reductant-halides. The combination of these steps enables the precursor material or set of more than one precursor materials to be converted efficiently into an elemental material or an alloy.

The present disclosure is not intended to be a primer on the formation of elemental materials or alloys. Readers are referred to appropriate available texts for background on these subjects.

According to one embodiment of the present invention, an elemental material is produced through a two-step process. An "elemental material" is a substance that is present in its elemental form, e.g., Ti or Co, as opposed to in its ionic form or as part of a chemical compound. Thus, it has a valence of 0.

First, a precursor material is converted by a reducing gas into an elemental material. At the same time, a by-product comprising a halogen moiety and the element or elements of the reducing gas is formed. This reaction is the "first reaction."

Second, the aforementioned by-product of the first reaction, which is referred to as a "first reaction product," reacts with a reductant material both to form a new substance comprised of the halide of the reductant, and to re-form the reducing gas. This reaction is the "second reaction." Preferably, there is sufficient manipulation of mixing and turbulence of the gas or vapor in the system such that they are strong enough to ensure that the concentration of the corresponding first reaction product is controlled by the second reaction. Thus, the formation of the elemental material is executed in the first reaction, and due to thermodynamics, is driven by the second reaction.

The precursor material will preferably be a metal or non-metal halide. The halogen within the precursor material may for example be Cl, Br, F or I or a combination thereof, but is preferably Cl, Br, F or a combination thereof. Further, preferably, the precursor material comprises a halide of at least one substance selected from the group consisting of Ti, Al, As, Sb, Be, B, Ga, Ge, Mo, Nb, Ta, Zr, V, Rh, Ir, Os, Ru, Pt, Pd, Re and U. Examples of precursor materials include, but are not limited to $TiCl_4$, $VCl_4$, $NbCl_5$, $MoCl_4$, $GaCl_3$, $UF_6$ and $ReF_6$. Further, the precursor material is preferably in the form of a vapor or droplet, referred to herein as a "halide vapor or droplet." If the precursor material is not in the form of a vapor or droplet, preferably, it will be converted into a vapor or droplet. Methods for converting a precursor material into a vapor or droplet are well-known to persons skilled in the art, and include but are not limited to dissolving the precursor material in a solvent and heating the solution or exposing it to an already heated gas.

The precursor material may be introduced into an environment that contains the reducing gas by, for example, submerging the precursor material in the reducing gas through an injector. Preferably, the injector will comprise a nozzle. The precursor material may be added to the reducing gas under conditions in which the gas is static or flowing; however, it is preferable to introduce the precursor material to the reducing gas when the reducing gas is a continuous stream.

The reducing gas reduces the precursor material to the elemental material. This first reaction is preferably exothermic, though as is well known to persons skilled in the art, the kinetics of the reduction for different reducing gases and/or different halides will be different.

The reducing gas may, for example, comprise one or more substances selected from the group consisting of $H_2$, $H_2S$, $NH_3$, $CH_4$, $CH_3Cl$, $CH_2Cl_2$, $CHCl_3$, $CH_3NH_2$, $CH_3SH$, $C_2H_2$, $C_2H_4$, $C_2H_6$, $C_2H_5Cl$, $C_3H_4$, $C_3H_6$, $C_3H_8$, $C_4H_{10}$, $C_4H_8$, $C_5H_{12}$, $CF_4$, $CF_3Cl$, $CF_2Cl_2$, $CFCl_3$, $CHF_3$, $CHF_2Cl$, $CHFCl_2$, $CF_3$—$CF_2$, $CF_3$—$CF_2Cl$ —$CFCl_2$,$D_2$, $B_2H_6$, $GeH_4$, and $SiH_4$. When $TiCl_4$ is to be reduced, preferably the reducing gas is $H_2$, $H_2S$, $CH_4$, or $NH_3$. $H_2$ is particularly preferable because it is clean, abundant, and relatively inexpensive.

Depending on the particular reducing gas or combination of reducing gases that is used, combining a particular precursor material with the reducing gas may generate one or more different first reaction products.

Optionally, the precursor material may be introduced to the reducing gas by being transported by a carrier gas. By way of example, any of the substances identified above as reducing gases may serve as carrier gases. Thus, the precursor material may be transported by a carrier gas that is the same chemical species as or a different chemical species than the reducing gas and then combined with or submerged in the reducing gas. Alternatively, the precursor material may be combined with an inert gas alone such as He, Ar, or $N_2$, which will serve as a carrier gas, and then combined with the reducing gas. When $TiCl_4$ is to be reduced, preferably the inert gas is Ar or He. In one embodiment, the carrier gas comprises both one of the aforementioned gases that are described as reducing gases and an inert gas.

After the first reaction begins and a first reaction product has been produced, the reductant material will react with the first reaction product and reduce and control its concentration in the system. The two reactions may occur simultaneously, instantaneously or sequentially. In this "second reaction," the reductant is preferably a solid, for example, a powder or pellet, or a liquid. For $TiCl_4$ reduction, by way of example, the reductant may be one or more substances selected from the group consisting of metals such as Al, Ba, Be, Ca, Ce, Cs, Hf, K, Li, Mg, Mn, Na, Pa, Rb, Sr, Th, U and Zr; and non-metals such as the oxides $CrO_2$, $CsO_4$, $KO_2$, $KO_4$, $NaO_3$, $NaO_4$, $RbO_4$, $UO_2$, and VO. The specific reductant solids or liquids that may be used in a particular application to reduce the product of the reducing gas and precursor material will, as discussed below, depend on the chemical and physical properties of the precursor material that is selected.

When there is sufficient excess of the reductant material over the stoichiometric quantity needed to react with the first reaction product, the temperature of the powder non-metal or metal that is produced may be controlled to prevent the powder from depositing on the equipment. Preferably, the reductant material will, based on stoichiometry, be present in greater than 6% excess relative to the first reaction product. As with the reducing gas, the reductant too may be added through a nozzle and in a continuous stream.

The reductant metal or non-metal is selected such that it forms a more stable halide material (the "second reaction product" or "reductant-halide") than the precursor material. The reductant-halide may be a solid, liquid, gas or mixture. However, it is important that the reductant-halide has a lower or more negative free energy of formation than the precursor material under the selected operating conditions. One may use more than one reductant material in a given system, though if more than one reductant is used, preferably each reductant forms a halide with lower formation free energy than the precursor material or materials that are reduced.

The above-described first reaction and second reaction may occur in one reactor, such as in a fluidized bed, or under conditions that prevent the precursor material from contacting the reductant material, such as in separate but gas permeable reactors or chambers that permit vapor to travel between them, and the concentration (or amount) of at least one of the products from the first reaction is controlled by the second reaction. During the combining of the precursor material with the reducing gas and optional carrier gas, one preferably maintains a sufficient turbulence or mixing in order to ensure an effective reaction of the first reaction product with the reductant material in the second reaction, and the concentration of the first reaction product in the system is controlled by the second reaction. Preferably, the precursor material is contacted with or submerged in a stream of reducing gas in the presence of the reductant material.

After the elemental material is formed, it should be separated from the other substances. Because there are two reactions that take place, under carefully controlled conditions, the elemental material and the reductant will not come into contact with each other regardless of whether being present in the same reaction vehicle. And more important is that the reductant-halide product will preferably not be formed on the surface of the elemental material. In these circumstances, the produced elemental material will be a powder that is not contaminated by the reductant or the reductant-halide. Consequently, the elemental material may easily be separated on the basis of methods known to persons skilled in the art for separating materials based on size and/or density, including but not limited to filtering and cycloning.

For example, one may use $H_2$ as the reducing gas, which under the preferred operating conditions of the present invention will cause the first reaction product to be gaseous HCl. Under these conditions, the HCl is easily separated from the Ti powder and will be able to react with the reductant material to form the reductant-halide; the formed reductant-halide is not physically (or mechanically) trapped by the Ti powder. By way of an additional example, one may use Al as the reductant to produce Ti from titanium tetrachloride. Al has a low boiling point, and $AlCl_3$ will be a vapor under preferred operating conditions. Thus, the Ti powder would be easily separated from the $AlCl_3$.

Further, the reductant-halide and re-formed reducing gas may be separated into constituent parts. The re-formed gas may be reused for the process described above or used to reduce other substances or in other applications in which such gases may be used. Similarly, the reductant-halide can be recovered and used.

Due to the limitations of most operating conditions, there may be some amount of unreacted precursor materials and first reaction products that will need to be treated or further processed. Recovered unreacted reductants may be used to treat these or additional first reaction products.

In one preferred sub-embodiment, Ti powder is produced according to the above-described method. When forming Ti powder, the Ti powder may be nucleated from the gas phase, if the thermodynamic driving force is great. Preferably, in generating the Ti powder, one uses a relatively large size reductant powder, pellet or droplet. This permits the newly produced smaller titanium to be carried to a further downstream area in a continuous-process injection reactor or to be carried out from the top in a fluidized-bed reactor, where it is easily separated and recovered.

Although not wishing to be bound by any one theory, it is believed that the benefit of the present invention is possible by forming one or more reductant-halides in the second reaction that have lower formation free energies (also referred to as larger negative formation free energies) than the precursor materials, when stoichiometric equivalents are compared.

As is well known to persons skilled in the art, precursor materials that contain halides may be reduced in the presence of a reducing gas such as hydrogen. For example, titanium tetrachloride may be reduced in the presence of hydrogen to form elemental titanium and hydrochloric acid. However, typically reactions such as these are not favored thermodynamically and must be carried out at elevated temperatures.

The thermodynamics of a reaction is reflected in the Gibbs fee energy of the reaction. Exemplary standard Gibbs free energies are provided in Table I below for both $TiCl_4$ and other chlorides that represent potential reductant-halide compositions, as well as precursor materials in and of themselves.

The reaction of Ti with $H_2$ is provided below in Formula I:

$$TiCl_4+2H_2 \rightarrow Ti\downarrow+4HCl \qquad \text{(Formula I)}$$

According to the present invention, by causing the halide product of this type of reaction, to enter a second reaction that forms a product with a lower formation free energy than the initial precursor material, the first reaction will be continuously driven to the right in order to compensate for the removal of the halide product of the first reaction. Due to thermodynamics, this will enable the first reaction to be carried out under a lower temperature, and thus be more cost-effective.

As is implied by this theory, for a given precursor material, it is important to select a reductant for which the product has a lower formation free energy than the precursor material and thus forms a more stable reductant-halide than precursor halide to drive the first reaction. If this is not the case, it will not drive the reaction described in Formula I to the right.

For a selected precursor material, the reductant material that can effectively facilitate reduction to the elemental material will be thermodynamically independent of the reducing gas. Thus, changing the reducing gas will not affect the selection of the reductant material from the point of view of thermodynamics, though it will affect the rate of the reaction via kinetics.

For example, if one were to continue with the reaction described above, one could use a metal such as Al, Mn, Mg, Na or Ca to generate a metal chloride and gaseous hydrogen. If one were to select Na, the reaction would be represented by Formula II:

$$HCl+Na \rightarrow \tfrac{1}{2}H_2+NaCl \qquad \text{(Formula II)}$$

As is reflected in Formula II, the elemental material, in this case the titanium described in Formula I, does not appear. In this second reaction, hydrogen gas is regenerated and sodium chloride is formed. More Ti is formed in response to the removal of Na, but its chemical form will not change. One additional benefit is that the hydrogen gas is regenerated and can be reused, while the amount of hydrochloric acid that will be produced is reduced.

The function of hydrogen in the overall $TiCl_4$ reduction reaction is like a catalyst. But to be exact, hydrogen is not a catalyst in the reaction because it is a reactant of the primary reaction and then a product of the second reaction. The participation of $H_2$ in the two reactions also greatly reduces the difficulty of the separation and increases the quality of the product because there is no physical trapping between the produced elemental material and the reductant-halide.

The above-described process preferably takes place at a temperature that is sufficiently low that the elemental material that is produced is quenched by contact with the reductant solid or liquid. Additionally, it is preferably below the sintering temperature of the elemental material. Moreover, it is desirable though not necessary to be able to run the reaction at atmospheric conditions.

Figure 3:
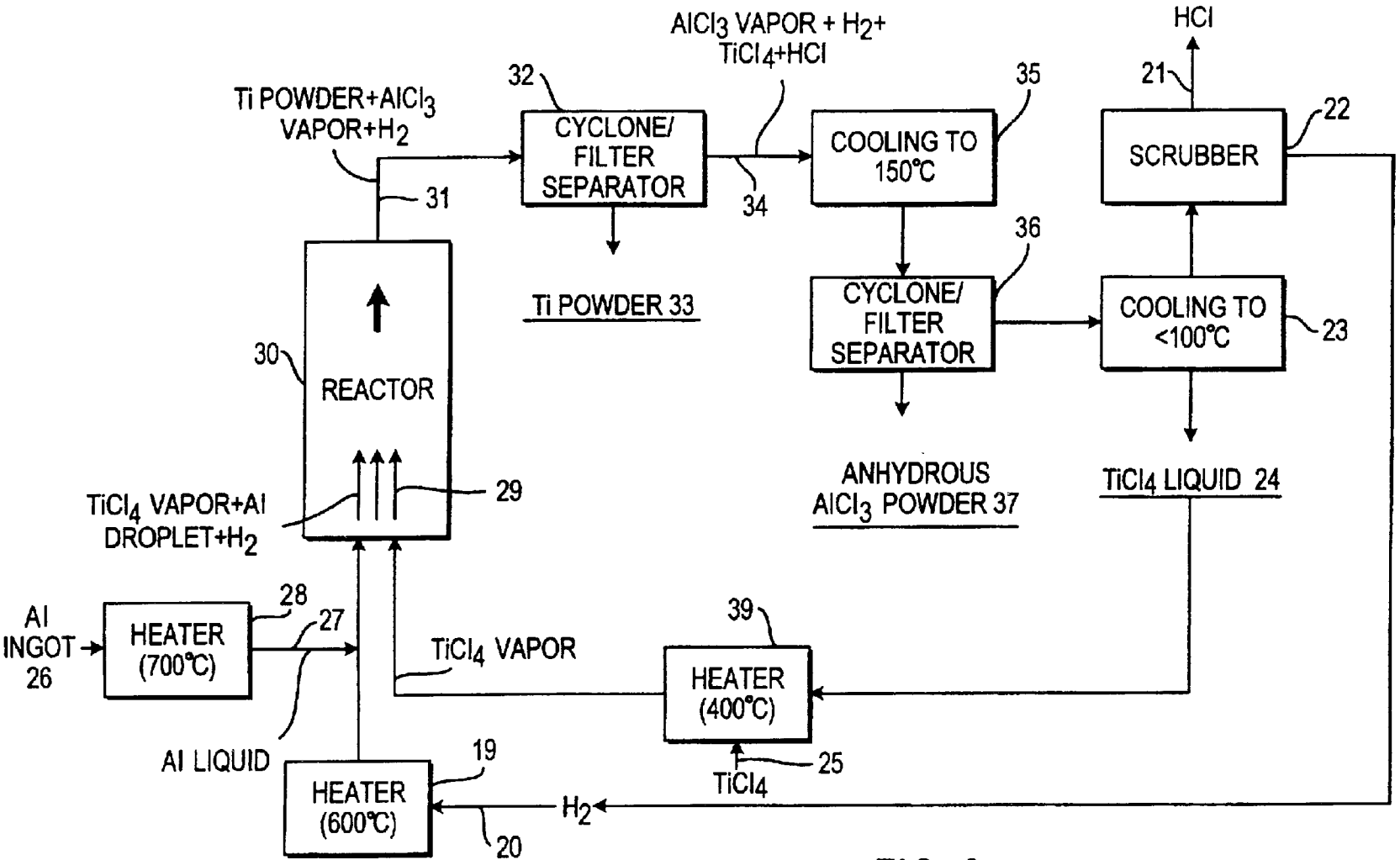
FIG. 3 is a representation of the processing steps of continuous titanium powder production by hydrogen and reductant materials.

FIG. 3 demonstrates a flow chart of one embodiment of this process. According to this process, $TiCl_4$, 25, may be heated, for example at 400° C. by a heater, 39, to form a $TiCl_4$ vapor. This material is sent to a reactor, 30. Also sent to the reactor is $H_2$, 20, that has been heated at for example, 600° C., 19, and an Al ingot, 26, that has been heated at for example, 700° C., 28, to form an Al liquid, 27. Thus, Al droplets, $H_2$ gas and $TiCl_4$ vapor will enter the reactor, 29.

The $TiCl_4$ is reduced, and $AlCl_3$ vapor, Ti and $H_2$ are formed, 31. These products are sent to a cyclone or filter separator, 32, and Ti powder may be recovered, 33. $AlCl_3$ vapor, $H_2$ and residual $TiCl_4$ and HCl, 34, are sent to a cooling stage, 35, where the substances are cooled to a temperature of approximately 150° C. Following this stage, there may be another cyclone or filter separator stage, 36, that permits the recovery of anhydrous $AlCl_3$ powder, 37. The other substances may be sent to another cooling stage, for example a cooling apparatus that cools the products to less than 100° C., 23, which will permit recovery of $TiCl_4$ in the form of a liquid, 24, which can be reheated, 39, and returned to the reactor. The hydrogen containing substance may be sent to a scrubber, 22, and HCl, 21, may be sent for waste treatment, while $H_2$, may also be sent back to the reactor.

Under different circumstances that may, for example, be dictated by limitations of equipment, one may choose to vary some of the operating conditions such as using a vapor or droplet as a source of the elemental precursor and varying the operating temperatures and pressures. For example, under one process of the present invention, one may use droplets of $TiCl_4$, $H_2$ gas, and Al powder to generate Ti powder and a solid $AlCl_3$ by operating at <130° C. and at ambient pressure. Alternatively, one may use $TiCl_4$ vapor instead of $TiCl_4$ droplets and operate at 130–177° C. and at ambient pressure, which would generate the same products. In still another variation, one may use $TiCl_4$ vapor, $H_2$ gas and Al as a mixture of droplets and powder by operating at between 180 and 660° C. at pressures between ambient and 3 atm to generate Ti powder and $AlCl_3$ vapor. Still further, one may choose to operate at greater than 660° C. at which temperatures all of the Al would be in the form of droplets, and at either ambient or elevated pressures to generate Ti powder and $AlCl_3$ vapor.

From a practical point of view, using a reducing gas such as $H_2$ in combination with a reductant material is different from using the reductant materials only. Hydrogen changes the $TiCl_4$ reduction from a heterogeneous surface reaction on the reductant metal surface to a homogeneous gas reaction.

Almost all heterogeneous surface reactions are limited by surface area, regardless of whether the reaction rate is controlled by surface chemistry or by mass transfer. If a reaction is controlled by surface chemistry, then the reaction rate will be proportional to the surface area. If a reaction is controlled by mass transfer, the reaction rate will be limited by the transportation of either reactant materials to the surface or the reacted products from the surface or both.

Homogenous reactions are not similarly limited. Consequently, the change to a homogeneous gas reaction will result in a substantial increase in the reaction rate. This is particularly important for the reductant metals that have relatively small thermodynamic driving forces, such as Al and Mn, of which the overall-reaction Gibbs free energy for $TiCl_4$ reduction are −101,200 and −143,800 J/mol at 298° K, respectively. These small thermodynamic tendencies can more easily be nullified by the activation energies caused by the surface reaction, which leads to the very slow reaction rate or no reaction at all.

TABLE 1

Metals being thermodynamically able for $TiCl_4$ reduction

| Metal | Chloride | $\Delta G^\circ_{298}$, formation of Chloride (KJ/mol) | $T_{metal\ melt}$ (° C.) | $T_{metal\ boil}$ (° C.) | Temperature Range for Effectively Thermodynamic $TiCl_4$ Reduction* (K) | Metal State in Temperature Range |
|---|---|---|---|---|---|---|
| (Ti) | ($TiCl_4$) | −737.2 | 1670 | | | liq |
| (Ti) | ($TiCl_4$) | −726.3 | | 3289 | | gas |
| Al | $AlCl_3$ | −628.8 | 660.45 | 2520 | 600–1800 | cry, liq |

TABLE 1-continued

Metals being thermodynamically able for $TiCl_4$ reduction

| Metal | Chloride | $\Delta G^{\circ}_{298}$, formation of Chloride (KJ/mol) | $T_{metal\ melt}$ (° C.) | $T_{metal\ boil}$ (° C.) | Temperature Range for Effectively Thermodynamic $TiCl_4$ Reduction* (K) | Metal State in Temperature Range |
|---|---|---|---|---|---|---|
| Ba | $BaCl_2$ | −810.4 | 729 | 1805 | 300–2500 | cry, liq |
| Be | $BeCl_2$ | −445.6 | 1289 | 2472 | 300–2500 | cry, liq, gas |
| Ca | $CaCl_2$ | −748.8 | 842 | 1494 | 300–2500 | cry, liq |
| Ce | $CeCl_3$ | −977.8 | 798 | 3443 | 300–2500 | cry, liq, gas |
| Cs | CsCl | −414.5 | 28.39 | 671 | 300–2500 | cry, liq, gas |
| Hf | $HfCl_3$ | −901.3 | 2231 | 4603 | 300–2500 | cry, liq |
| K | KCl | −408.5 | 63.71 | 759 | 300–2500 | cry, liq, gas |
| Li | LiCl | −384.4 | 180.6 | 1342 | 300–2500 | cry, liq |
| Mg | $MgCl_2$ | −591.8 | 650 | 1090 | 300–2500 | cry, liq, gas |
| Mn | $MnCl_2$ | −440.5 | 1246 | 2062 | 300–2500 | cry, liq, gas |
| Na | NaCl | −384.1 | 97.8 | 883 | 300–1250 | cry, liq, gas |
| Pa | $PaCl_4$ | −953.0 | 1572 | — | 300–2500 | cry, liq |
| Rb | RbCl | −407.8 | 39.48 | 688 | 300–2500 | cry, liq, gas |
| Sr | $SrCl_2$ | −781.1 | 769 | 1382 | 300–2500 | cry, liq, gas |
| Th | $ThCl_4$ | −1094.5 | 1755 | 4788 | 300–2500 | cry, liq |
| U | $UCl_3/UCl_4$ | −799.1/−930.0 | 1135 | 4134 | 300–2500 | cry, liq |
| Zr | $ZrCl_4$ | −889.9 | 1855 | 4409 | 300–2500 | cry |

*The Gibbs free energy is calculated and compared in the range of 300 to 2500 K, which is the preferred rant of operation, but application will be beyond the range.

For example, from the thermodynamic calculation, $TiCl_4$ can be reduced directly by Al or Mn. This reaction is summarized in Formulas III and IV:

$$3TiCl_4+4Al \rightarrow 3Ti+4AlCl_3 \quad \text{(Formula III)}$$

$$TiCl_4+2Mn \rightarrow Ti+2MnCl_2 \quad \text{(Formula IV)}$$

However, if the reduction of $TiCl_4$ is performed according to the methods of the present invention, there will be two reactions, Formulas V and VI or Formulas V and VII below:

$$TiCl_4+2H_2 \rightarrow Ti+4HCl \quad \text{(Formula V)}$$

$$6HCl+2Al \rightarrow 3H_2+2AlCl_3 \quad \text{(Formula VI)}$$

$$TiCl_4+2H_2 \rightarrow Ti+4HCl \quad \text{(Formula V)}$$

$$2HCl+Mn \rightarrow H_2+MnCl_2 \quad \text{(Formula VII)}$$

By using the pairs of reactions represented by Formulas V and VI or Formulas V and VII, the activation energy of the reaction of Formula V is significantly lower than the activation energy to that of Formulas III or IV. Additionally, if one uses excess Al or Mn to increase the surface area the activation energy of reaction of Formula VI or VII can be reduced.

Further, as persons skilled in the art know, if $TiCl_4$ is reduced solely by a metal, the newly-born titanium metal and the produced metal halide, most of which is solid or liquid under preferred operating conditions, will form simultaneously on the surface of the reductant metal and be physically trapped by one another. Therefore, one must address how to separate the produced Ti product from the original reductant metal and reductant-halide. By contrast, using $H_2$ with metals changes the formation process of the titanium powder. The titanium powder can be nucleated from the gas phase and grown on it if the thermodynamic driving force is great enough. Even if when $H_2$ is used, the thermodynamic driving force is not great for nucleation under typical operating conditions, seeds can be added. The seeds may be either the same material as the to-be-reduced elemental material, such as Ti, or an easy-to-handle material such as $AlCl_3$. For the former type of seed, no separation step is necessary. The latter type of seed can be easily washed out or vaporized in a relatively low temperature from the titanium powder.

The means for combining the precursor material with the reducing gas and the reductant material are not limited to any one particular means, and any means that is now known or that comes to be known to persons skilled in the art that would be useful with the present invention may be used. For example, the precursor material may first be submerged in a static or flowing reducing gas and the first reaction product may be exposed to a reductant material in the form of a solid or liquid to form an elemental material and a reductant-halide.

Under a preferred method, the precursor material and the reducing gas flow continuously through a device such as a nozzle with concentric portions. The elemental material and the reducing gas may flow through the inner nozzle while the reductant material flows through the outer nozzle. Under this embodiment, it will be preferable for the vapor flow to be turbulent.

In a second embodiment of the present invention, one may use a seed to produce an alloy of elemental materials from a precursor material or to assist in forming the elemental material. According to this embodiment, a precursor material as described above, may be exposed to a reducing gas by for example, submerged injection in the presence of additional metal particles as seeds to reduce the halide on the seeds and to form an alloy with the seed material. As with the prior embodiment, the first reaction product would be contacted with a reductant solid or liquid material.

During this process, which is preferably a continuous process, for $TiCl_4$ reduction, the seed may, for example, the one or more of the following, Al, B, Be, Ga, Sb, Ta, Mo, Nb, Sn, Cr, Fe, V, Mg, Na, Mn, Zr, or Ca, and the temperature of the solid or liquid reductant away from where the halide vapor is introduced is preferably maintained in the range of from about −50° C. and 1200° C. Further, the seed may be the same substance as the element, in which case it facilitates the formation of the elemental material, or comprise an element or elements that can form an alloy with the element of the precursor material. Preferably, the seed is a metal that can form a stable alloy with the substance in the precursor material to be reduced.

The seed is preferably introduced as a particle or droplet through a nozzle, and may be introduced as part of the carrier gas described above. Additionally, the seed preferably possesses an average particle size in the range of 0.1 micrometers to 1 millimeter. When using a seed, the immediate product from the reaction of the precursor material and the reducing gas may be a pre-alloy or elemental blend that may need to be subsequently treated to form an alloy that may be used commercially.

For example, one may use this method to produce a Ti-6Al-4V. Vanadium cannot effectively reduce $TiCl_4$ under the preferable operating temperature and pressure. A mixture of fine Al and V powders with a weight ratio of 3/2 for Al and V may be used as seeds, where the Al is in 6% stoichiometric excess relative to $TiCl_4$. When this mixture is heated to above 660° C., such as 700° C., Al will become molten and V will stay as particles in the melt because of their different melting points. The melting point for Al and V are 660 and 1910° C., respectively. If this molten mixture is injected (at the temperature above 660° C., such as 700° C.) into the reactor at a certain speed as seeds, it may turn into individual vanadium particles surrounded with molten Al. If the HCl concentration in the reactor is controlled by adding a stronger-reducing metal (e g. Mg or Na) the $TiCl_4$ will be preferably reduced by $H_2$ but nucleated and grown on the surface of the seeds to form a Ti—6Al—4V alloy or pre-alloy depending on the operating temperature.

Alternatively, in a third embodiment an alloy may be produced by using more than one elemental precursor in the same reaction system. In this case, if two precursor materials that use the same halogen were used, at least one type of first reaction product would be formed. If different halogens were used then there would be more than one type of first reaction product, in which case collectively there would be "first reaction products." The third embodiment can be used in combination with the second embodiment. Thus, one could use a seed and more than one precursor material.

In any of the embodiments, the elemental material or alloys thereof may, for example, be produced continuously in a fluidized bed at a certain flow velocity and turbulent pattern. The flow velocity and the pattern is preferably sufficient to keep the precursor material and the reductant material fluidized and the concentration of the first reaction product being controlled by the second reaction, which will depend in part on the parameters of the apparatus selected and the chemical substance used.

If the quantity of the reductant material is sufficiently in excess of the stoichiometric quantity necessary to reduce the halide vapor for quenching the reaction products below the sintering temperature of the produced elemental material or alloy, it is possible to recover or to remove the heat from the excess elemental material and/or the reductant material. Thus, it is possible, according to the present invention, to produce elemental materials and alloys that do not sinter.

By way of example, a continuous process reactor may be used for the titanium powder and alloy production, as shown in FIG. 1. In this process, $TiCl_4$, 1, may be injected and if not already in the form of a droplet or vapor, be converted into that form, 10, and sent to the reactor chamber where it will quickly react with $H_2$, 2, to form Ti powder and HCl. Al (or other corresponding reductant metals or chemicals), 3, may be injected while being exposed to a heater, 4, and combined with the halide droplet or vapor, 5. In the reaction chamber the reductant will reduce and control the HCl concentration by forming $AlCl_3$ and $H_2$. Either droplet or powder of Al may be used depending on the reaction chamber's operating temperature.

The carrier gases, not shown, may, for example, be Ar or He, depending on the requirement of the $H_2$ concentration for the reaction and/or price. Optionally, there can be the introduction of seed, by, for example, injection, 9, which would facilitate the nucleation of Ti powder and/or the formation of an alloy.

The production rate, produced particle size, shape and density will be functions of the reaction thermodynamics and kinetics. They can in part be controlled by reaction temperature, e.g., a furnace, 6. Ti powder, 8, may be nucleated from the first reaction and grown on the nuclei or the added seeds and leave the reactor with the exhaust gas, including the residual hydrochloride, $TiCl_4$ and metal chloride, 7.

Figure 2:
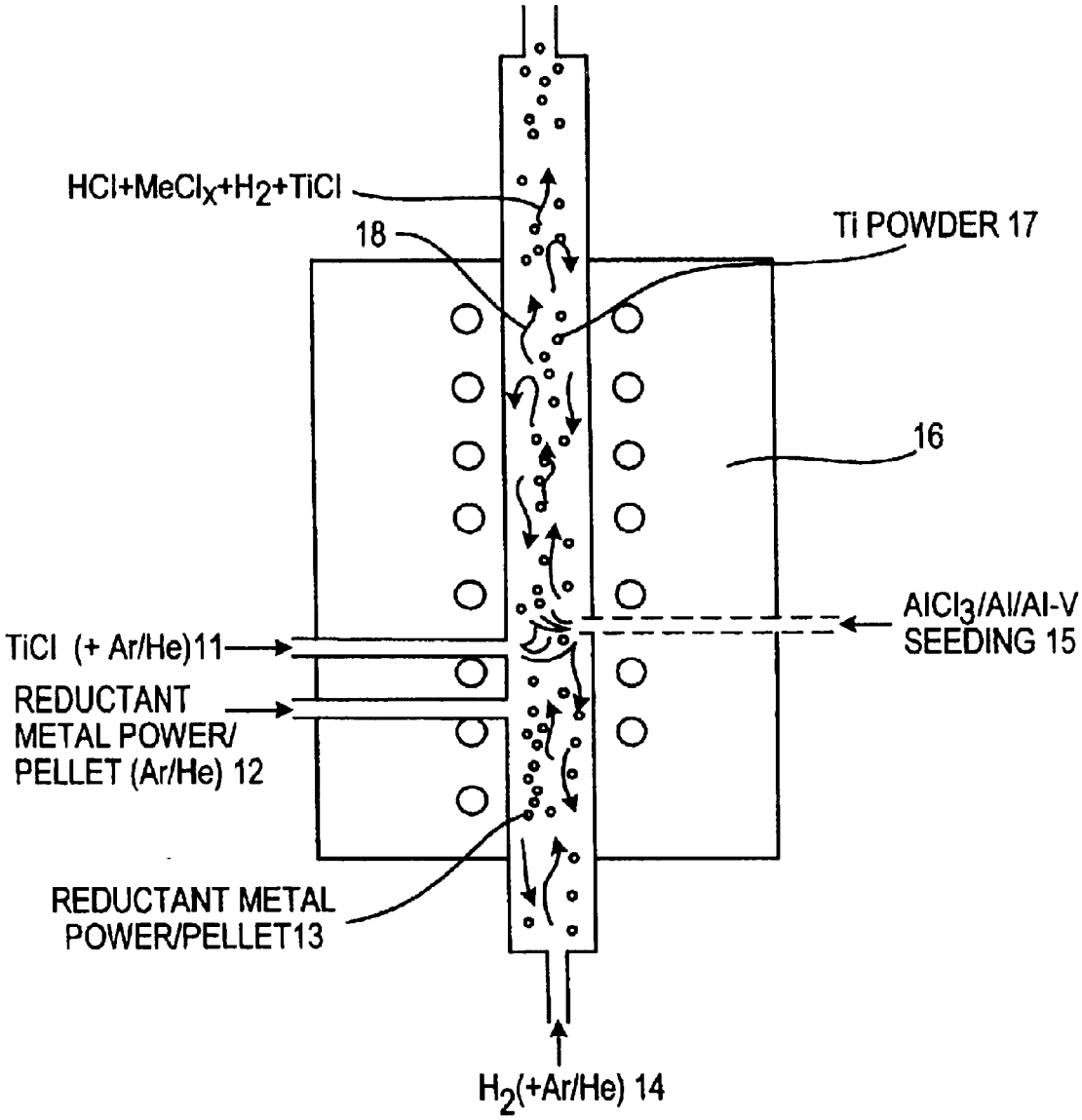
FIG. 2 is a representation of the fluidized-bed reactor of continuous titanium powder production by hydrogen and reductant materials.

A fluidized-bed reactor may also be used for Ti and Ti-alloy powder production, as shown in FIG. 2. $TiCl_4$ may, for example, be introduced into the system from the middle of the reactor and reduced to Ti powder by $H_2$ in the gas phase of the upper portion of reactor. The produced Ti powder, which has a relatively small size may be carried out from the top of the reactor by the exhaust gas. The continuous and excess reductant metal pellets with relatively larger size will stay and be fluidized by $H_2$ (or Ar or He or a mixture thereof) in the bed to react with the HCl and control the concentration of HCl in the reactor.

Thus as shown in the figure, $TiCl_4$ in the presence of Ar or He, 11, may be injected into a chamber tube that contains the reducing gas, 14. Similarly, reductant metal powder or pellets may be injected by means of a carrier gas of Ar, $H_2$ or He or a mixture thereof, 12. Optionally, a seeding material may also be added, 15. The chamber tube may be located within a furnace, 16, which allows one to add heat to the system.

In the chamber, the $TiCl_4$ will react to form Ti powder, 17, and HCl. The HCl will react with the reductant to form a reductant chloride and $H_2$, which along with the residual $TiCl_4$ and HCl can be removed by the exhaust gas, 18. Similarly, unreacted reductant will not be carried away with the metal chloride, 13, because of its relative larger particle size. Moreover, even if some small size unreacted reductant particles will be carried out along with the product Ti powder from the top of the reactor by the exhaust gas, since they have no physical (or called mechanical) trap with Ti powder, they can be easily separated from the Ti powder based on the difference of the physical and chemical properties between the reductant and Ti particles, such as, density, surface zeta potential, magnetic induction, chemical stability, etc.

A certain gas-flow pattern and turbulence are preferably included in order to ensure that the concentration of HCl in the reactor is controlled by the second reaction, i.e., the reaction between the HCl and the reductant material, which is essential for the success of the process. Further, the continuous existence of excess of reductant in the reactor will increase production rate and product stability.

The elemental materials and alloys that are produced according to the present invention can by way of example be used in applications in which similar substances produced by other methods may be used and include, but are not limited, to final products, also known as mill products or chunky parts, for the automobile, sports and aerospace industries. The elemental materials and alloys may be incorporated into these applications by, for example, powder-metallurgy techniques such as laser sintering, powder injection molding, cold spray and roll forming.

EXAMPLES

While the invention has been described in connection with specific embodiments thereof, it will be understood that it is capable of further modifications and this application is intended to cover any variations, uses, or adaptations of the invention following, in general, the principles of the invention and including such departures from the present disclosure as come within known or customary practice within the art to which the invention pertains and as may be applied to the essential features hereinbefore set forth and as follows in the scope of the appended claims.

Experimental Setup

The experimental setup for preliminary kinetic investigation consists of an $H_2$—Ar gas supply system, a $TiCl_4$ supplying system, a reactor and a sampling system. A 1"—OD×⅛"-thick×2'—long inconel tube was used as the outer shell of the reactor chamber. The inconel tube was a nickel-based alloy (~75% wt of Ni, ~15% Cr and ~7% Fe), which can operate at temperature up to 1300° C. In order to prevent the reactions of the inconel tube with $TiCl_4$ vapor and reductant metals, a ¾"—OD×⅛"-thick×2'—long quartz tube was inserted inside the inconel tube as the inner reaction chamber. A Lindberg/Blue tube furnace (Asheville, N.C.) was used to heat the reactor, which enables one to increase the temperature up to 1100° C.

$H_2$ and Ar were supplied from the standard commercial cylinders. ¼"-ID stainless steel tubes were used for the $H_2$, Ar and $TiCl_4$-vapor flow-in transfer. A ½" stainless steel tube was used between the reactor and the sampler for the exhaust gas and particle flow-out transfer. $TiCl_4$ was provided as liquid from a stainless steel reservoir and carried into the reactor as vapor by $H_2$/Ar.

In order to avoid the oxygen leaking into the reactor, the inside pressure of the reactor was kept slightly (1–3 psig) above ambient under the designed mass flow rate. The various reaction temperatures in the kinetic study were tested. The reaction temperature was first started at 600° C. for the selected reductant metal, then gradually increased or decreased at ~100° C. intervals for each run. 0.2 L/min of $H_2$and 0.1 L/min of $TiCl_4$ vapor of the flow rates were used as the starting values. If necessary, the liquid $TiCl_4$ tank could be heated to increase the $TiCl_4$ flow rate (vapor pressure). Mg and Al were tested.

The experimental procedures were performed in the order by reductant metal powder/pellet loading, Ar purge, $H_2$ purge, heating, $TiCl_4$ and reductant metal introducing, seeding, (reaction), cooling, sampling and sample analysis.

Example 1

1 g of Mg powder, (Alfa Aesar, −325 mesh (<44 μm in diameter), 99.8% purity), placed in an alumina crucible of 70 (long)×10 (wide)×5 (high) mm was used as the reductant metal for the $TiCl_4$ reduction by $H_2$. The experiment was carried out by the procedures described above at the temperature of 600° C. for 30 min then at 700° C. for 20 min.

After the experiment, the color of the 2-mm surface powders in the crucible changed from original gray to black, and their particle sizes changed to 0.5–2 mm. Most of the powders in the bottom of the crucible still retained their original color and size of the Mg powder, while some particles with metallic shining color and sub-millimeter size existed among them, which could be seen by naked eyes. Many particles in the diameters of sub millimeters with black or metallic shining colors were found in the downstream reaction tube and the Sampling Vessel. The samples were separately collected from the crucible and the Sampling Vessel and analyzed by scanning electron microscopy coupled with energy dispersive X-ray (SEM-EDX) and X-ray diffraction spectroscopy (XRD).

SEM-EDX detected that about 5% and about 30% of the materials in the powders collected from the crucible was titanium and magnesium, respectively. Some of the titanium particles were trapped with the magnesium particles and some stood separately. More importantly, the results from SEM-EDX analysis indicates that the powders collected from the Sampling Vessel contained about 70% of titanium but no magnesium at all. The vapor pressure of magnesium at 700° C. is calculated as 0.00987 atm, which is not sufficient to reduce $TiCl_4$ to titanium powder. Therefore, the powders, particularly collected in the Sampling Vessel should be produced via the $TiCl_4$ reduction by $H_2$. More discussion about this is made in example 2 below. XRD indicated the existence of crystallized Ti in the sample collected from the crucible and found a certain amount of titanium monoxide (TiO) in the sample collected from the Sampling Vessel. TiO is believed to be formed from the oxidation of particulate Ti metal during the sampling process.

Example 2

A control experiment was carried out to confirm the function of and the route through the reducing gas, for example, $H_2$, for the present invention. The experiment was conducted in the same way as example 1 except that Ar substituted $H_2$ (no $H_2$ was used at all). After the experiment, no particle was found in the Sampling Vessel and downstream tubes, which was different from the result of example 1, where a certain amount of the particles were founded from the Sampling Vessel and the downstream tube. Therefore, as discussed above, the particles in the Sampling Vessel and the downstream tube in example 1 were produced via the $TiCl_4$ reduction through $H_2$.

Example 3

The experimental condition used was the same as Example 1 except that the reaction was carried out at 900° C. for 30 min then at 1000° C. for 20 min. After the experiment, the color and size of all of the powders in the crucible were changed. In the crucible orientation, the color of all of the powders in the upstream half (about 35 mm long) of the crucible became black, while the color of the powders in the downstream half (~35 mm long) of the crucible became white. Most of the powders in the crucible were in the size range of sub-millimeters to 2 millimeters. SEM-EDX detected the black powders contained about 75% of titanium and about 5% of Mg, and the white powders contained about 70% of Mg and 2% Ti. The black powder was metallic titanium, while the white powder was $MgCl_2$. Similar to Example 1, SEM-EDX also indicated that the powders collected from the Sampling Vessel and the downstream tubes contained about 50% of titanium but no magnesium at all.

Example 4

1 g of Al powder, (Alfa Aesar, −325 mesh (7–15 μm in diameter), 99.5% purity), placed in the alumina crucible was used as the reductant metal for the $TiCl_4$ reduction by $H_2$. The experiment was carried out following the procedures described above at 550 and 600° C. for 60 and 30 min, respectively both of which were below the Al melting point of 660° C. After the experiment, about 1-mm-thick surface powders in the crucible were changed from the original gray color to black and from the original 7–15 μm particle size to sub-millimeters and millimeters. A small amount of particles were formed in the downstream tubes. SEM-EDX detected the powder and flake samples collected from the top of the crucible contained about 20% and 40% of Ti, and 60% and 34% of Al, respectively. XRD indicated that the powder consisted of a large quantity of Ti0.36Al0.64 alloy. For the powder sample collected from the downstream tube, the concentrations of Ti and Al were found by SEM-EDX as about 23% and 4%, respectively.

Example 5

The experimental condition used was the same as Example 3 except that the reaction was carried out at 700° C. for 30 min then at 750° C. for 20 min, which was above the Al melting point of 660° C. After the experiment, the color and size of all of the powders in the crucible were changed. About 20% of the powders changed from the original gray color to black and from the original 7–15 $\mu$m particle size to sub-millimeters and millimeters. The rest of unreacted Al powder changed to one big piece with a dimension of about 50 (long)×5 (wide)×2 (high) mm and a metallic Al color. A small amount of the particles were formed in the downstream tubes. XRD detected that a large quantity of $Al_xTi_y$ alloy and a certain amount of Ti metal and TiO existed in the sample collected from the crucible. The ratio of Al to Ti in the alloy varied from $Al_3Ti$ to AlTi, which was different from the results discussed in Example 4 above.

What is claimed:

1. A method of producing an elemental material comprising Al, U, Ti, V, or Zr, said method:

combining a precursor material, a reducing gas, and a reductant material, to form said elemental material, a first reaction product and a reductant-halide, wherein said precursor material comprises a halide of said elemental material.

2. The method according to claim 1, wherein said reductant-halide has a lower formation free energy than said precursor material.

3. The method of claim 2, wherein the precursor material is comprised of one or more of the moieties selected from the group consisting of Cl, Br and F.

4. The method of claim 2 further comprising using an inert gas as a carrier gas for said precursor material.

5. The method of claim 4, wherein the inert gas comprises Ar, He, $N_2$ or mixtures thereof.

6. The method of claim 1, wherein said precursor material is in the form of a halide vapor or droplet or mixture thereof.

7. The method of claim 6, wherein the halide vapor or droplet is one or more of $TiCl_4$, $VCl_4$, or $UF_6$.

8. The method of claim 6, wherein said combining comprises introducing the halide vapor or droplet submerged in the reducing gas; said reducing gas is static or flowing; said reductant is a solid or liquid metal; and said elemental material is a powder.

9. The method of claim 6, wherein there is an excess of the reductant material over the stoichiometric quantity needed to react with the halide vapor or droplet.

10. The method of claim 9, wherein said excess is greater than six percent.

11. The method of claim 1, wherein the reducing gas comprises at least one substance selected from the group consisting of $H_2$, $H_2S$, $NH_3$, $CH_4$, $CH_3Cl$, $CH_2Cl_2$, $CHCl_3$, $CH_3NH_2$, $CH_3SH$, $C_2H_2$, $C_2H_4$, $C_2H_6$, $C_2H_5Cl$, $C_3H_4$, $C_3H_6$, $C_3H_8$, $C_4H_{10}$, $C_4H_8$, $C_5H_{12}$, $CF_4$, $CF_3Cl$, $CF_2Cl_2$, $CFCl_3$, $CHF_3$, $CHF_2Cl$, $CHFCl_2$, $CF_3$—$CF_3$, $CF_3$—$CF_2Cl$, $CF_2Cl$—$CFCl_2$, $D_2$, $B_2H_6$, $GeH_4$, and $SiH_4$.

12. The method of claim 1, wherein the reductant material is a solid or liquid or a mixture thereof.

13. The method of claim 12, wherein the reductant material comprises at least one substance selected from the group consisting of Al, Mn, K, Na, Li, Ba, Ca, Mg, Be, Ce, Cs, Hf, Pa, Rb, Sr, Th, U and Zr.

14. The method of claim 1, further comprising combining a seed with said precursor material, said reducing gas and said reductant.

15. A method of producing an alloy comprising at least one of Al, Ti, U, V, or Zr, said method:

combining a precursor material, a seed, a reducing gas, and a reductant material, to form said alloy, a first reaction product, and a second reaction product wherein said precursor material comprises a halide of an elemental material.

16. The method according to claim 15, wherein said seed comprises an element that is the same as an element in the precursor material and/or one or more substances that can form an alloy with the element material in the precursor.

17. The method according to claim 16, wherein said seed comprises at least one substance from the group consisting of Al, Be, B, Fe, Ga, Mo, Nb, Sb, Ta, V and Zr.

18. A method of producing an alloy comprising at least one of Al, Ti, U, V, or Zr, said method comprising:

combining at least two precursor materials, a reducing gas, and a reductant material to form said alloy, at least one first reaction product, and at least one second reaction product, wherein said at least two precursor materials comprise halides of elemental materials.

19. The method according to claim 18, wherein one of said at least two precursor materials comprises $TiCl_4$.

20. A method of producing elemental Ti comprising:

(a) combining a $TiCl_4$ with a reducing gas selected from the group consisting of $H_2$, $H_2S$, $NH_3$, and $CH_4$ to form Ti and a first reaction product; and (b) exposing said a first reaction product to a reductant material selected from the group consisting of Al, Mn, Mg, Na, Ca, Li, K, Ba, Be, Ce, Cs, Hf, Pa, Rb, Sr, Th, U, Zr, $CrO_2$, $CsO_4$, $KO_2$, $KO_4$, $NaO_3$, $NaO_4$, $RhO_4$, $UO_2$, and VO to form a second reaction product.

* * * * *